US005822896A

United States Patent [19]

Milstein

[11] Patent Number: 5,822,896

[45] Date of Patent: Oct. 20, 1998

[54] DIORAMIC GREETING CARD

[76] Inventor: Jeffrey Milstein, 2600 Rte. 212, Woodstock, N.Y. 12498

[21] Appl. No.: 701,310

[22] Filed: Aug. 21, 1996

[51] Int. Cl.[6] ..... G09F 1/00

[52] U.S. Cl. ..... 40/124.07; 40/124.12; 40/124.19; 40/750; 229/92.8

[58] Field of Search ..... 40/124.01, 124.07, 40/124.09, 124.12, 124.16, 124.19, 738, 743, 750, 752, 786, 788, 789, 100, 155, 152.1; 229/92.8

[56] References Cited

U.S. PATENT DOCUMENTS

| | | | |
|---|---|---|---|
| 956,916 | 5/1910 | Wiederseim, Jr. | 40/775 X |
| 1,130,782 | 3/1915 | Willens | 229/92.8 |
| 1,143,729 | 6/1915 | Schmidt | 229/92.8 X |
| 2,428,772 | 10/1947 | Aranoff | 40/789 |
| 2,860,437 | 11/1958 | Carroll . | |
| 2,862,322 | 12/1958 | Ziegler . | |
| 2,873,545 | 2/1959 | Noel . | |
| 2,971,282 | 2/1961 | Petrey . | |
| 2,991,699 | 7/1961 | Murray, Sr. | 229/92.8 X |
| 3,234,676 | 2/1966 | Colicki et al. | 40/748 X |
| 3,333,358 | 8/1967 | Green et al. . | |
| 3,596,391 | 8/1971 | Knight, Jr. . | |
| 4,622,769 | 11/1986 | Friedman | 40/750 |
| 4,681,253 | 7/1987 | Engelhardt . | |
| 4,750,283 | 6/1988 | Halpern | 40/750 |
| 5,135,157 | 8/1992 | Cruz . | |
| 5,186,384 | 2/1993 | Nelson . | |
| 5,441,778 | 8/1995 | Gilbreath et al. . | |

FOREIGN PATENT DOCUMENTS

| | | | |
|---|---|---|---|
| 183576 | 7/1922 | United Kingdom | 40/100 |
| 873204 | 7/1961 | United Kingdom | 40/100 |
| 1364149 | 8/1974 | United Kingdom | 40/100 |

*Primary Examiner*—Brian K. Green
*Assistant Examiner*—Andrea Chop
*Attorney, Agent, or Firm*—Gottlieb, Rackman & Reisman, P.C.

[57] ABSTRACT

A dioramic greeting card is provided. The card has a construction comprising three panels or segments. One panel has a viewing window, the second panel typically has a written message imprinted thereon, and the third panel includes an attractive picture or photo display. The card's construction is made from a cardboard blank which is appropriately folded and manipulated in order to construct the greeting card. The blank includes a series of panels foldably connected to each other along common fold lines.

5 Claims, 1 Drawing Sheet

DIORAMIC GREETING CARD

BACKGROUND OF THE INVENTION

This invention is directed to a greeting card, and more particularly, to a dioramic greeting card having a viewing window through which a picture or photo display or other decorative indicia disposed on a concave panel behind the window is viewed.

Greeting cards are a staple product of stationery supply stores, greeting card stores, gift stores, museum shops and the like and are purchased by individuals for any type of holiday or celebratory occasion or to remember a visit to a specific location. A typical greeting card includes some type of picture on the front face, and a preprinted message written inside. There are, of course, many companies which produce and offer for sale such cards, obviously creating keen competition in the marketplace. In this regard, some cards include one or more novelty features, such as a sound-producing element for producing a sound which coordinates with the message depicted in the card. Other cards may be uniquely folded to provide an interesting pattern or just simply so that the card may better stand upright on a display table or other display piece of furniture.

SUMMARY OF THE INVENTION

Generally speaking, in accordance with the invention, a dioramic greeting card is provided. The card has a construction comprising three panels or segments. One panel has a viewing window, the second panel typically has a written message imprinted thereon, and the third panel includes an attractive picture or photo display or other decorative indicia. The card is made from paper or paper equivalent blank which is appropriately folded and manipulated in order to construct or erect the greeting card. The blank includes a series of the above-described panels foldably connected to each other along common fold lines.

The greeting card of the invention is normally sold and/or mailed in a folded, flat condition. The greeting card may then be folded in such a manner as to provide a three-dimensional dioramic card display. The front of the card display includes the viewing window through which a picture, photo or other indicia is viewed.

Accordingly, it is an object of the invention to provide an improved greeting card construction, foldable readily from a flat condition to an erect condition.

It is another object of the invention to provide a dioramic greeting card.

Yet a further object of the invention is to provide a greeting card assembly having a three dimensional display.

Still another object of the invention is to provide a greeting card construction which may be made flat for sale and shipping purposes.

A further object of the invention is to provide a cardboard blank for constructing a dioramic greeting card, especially one which is printed only on one side.

Still other objects and advantages of the invention will in part be obvious and will in part be apparent from the following description.

The invention accordingly comprises the several steps, and the relation of one or more such steps with respect to the others, and the article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
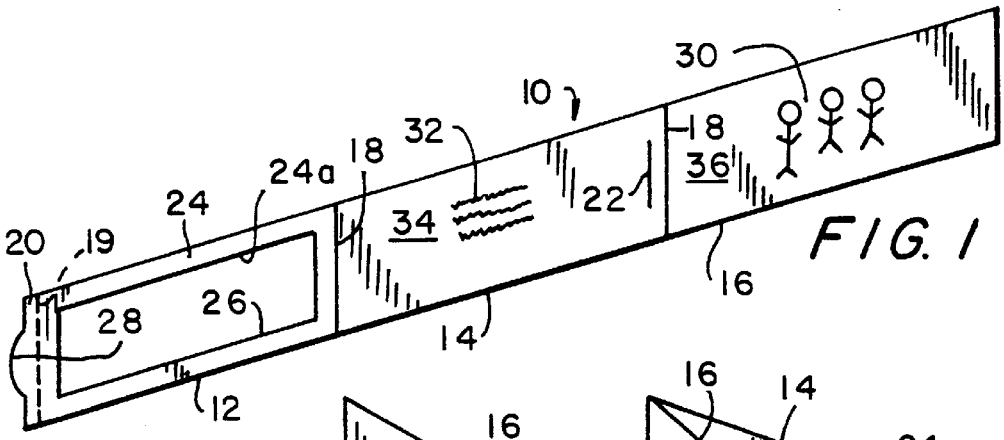
FIG. 1 is a perspective view of a blank from which the greeting card, in accordance with the invention is constructed.

Referring first to FIG. 1, a paper or paper equivalent blank 10, from which the greeting card of the invention is constructed, is shown. Cardboard blank 10 is made from a foldable, flexible paper material and includes a series of panels 12, 14 and 16 foldably connected to each other along fold lines 18. Desirably, each panel is rectangular.

Figure 2:
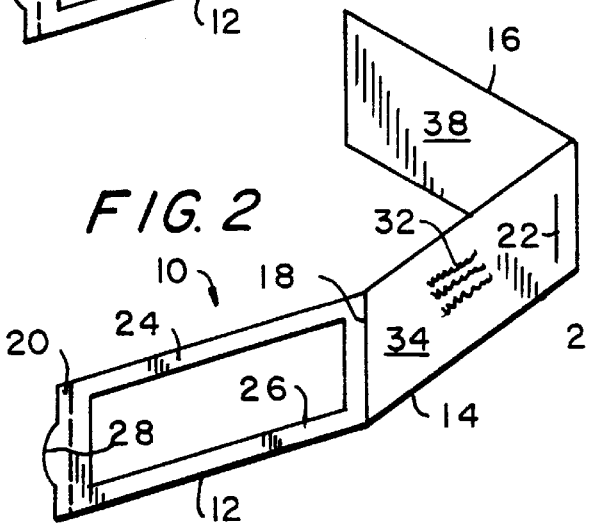
FIG. 2 is a perspective view of the blank of FIG. 1 as folding begins to construct the greeting card of the invention.

A first panel 12 has a flap 20 attached thereto along a fold line 19, as best depicted in FIGS. 1 and 2. Flap 20 is formed with a protruding centrally located tab 28 which is sized for selective engagement with a slit 22 formed in second panel 14 when the greeting card of the invention is finally assembled, as described in greater detail hereinbelow.

Panel 12 comprises a frame 24 for defining a viewing window 26. As shown in the drawings, viewing window 26 is substantially rectangular in configuration. However, any geometric configuration may be designed for window 26 in order to carry out the objects of the invention. By way of example, edge 24*a* may be convex.

Figure 3:
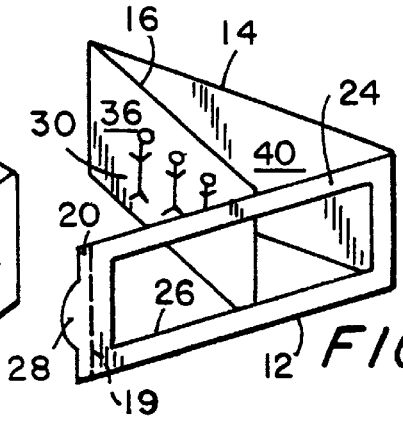
FIG. 3 is also a perspective view of the blank of FIG. 1 showing a further step in the folding process in order to construct the greeting card of the invention.

Referring now to FIGS. 1, 2 and 3, second panel 14 comprises a front face 34 on which written information 32 is imprinted thereon, and a rear face 40. By way of example, information 32 may give information relating to the display 30, later discussed. Third panel 16, which is foldably connected to panel 14 along fold line 18, comprises a front face 36 on which a photo or picture display or other decorative indicia 30 is imprinted, and a rear face 38. Rear face 38 of third panel 16 and rear face 40 of panel 14 together define the back of blank 10. Desirably, the back of blank 10 is not provided with any type of printed or photographic material thereon. However, the purchaser of the card may write his/her own notes or greetings on blank faces as on face 40.

Figure 4:
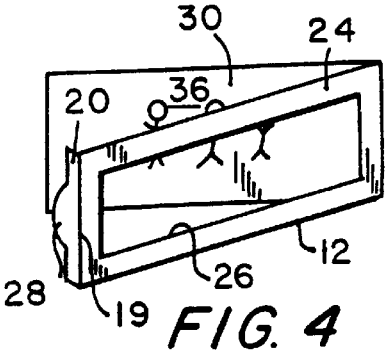
FIG. 4 is a perspective view which illustrates the greeting card of the invention just prior to complete assembly.

In order to erect the greeting card of the invention from blank 10, panels 14 and 16 are folded inwardly, as best shown in FIGS. 2–4, so that panels 14 and 16 are substantially aligned one over the other. This is, in part, achievable since the panels 14 and 16 have essentially the same rectangular configuration. In this partially folded condition, as depicted in FIG. 4, both front faces 34 and 36 of panels 14 and 16 respectively are exposed to view, while rear faces 38 and 40 are hidden from view.

Figure 5:
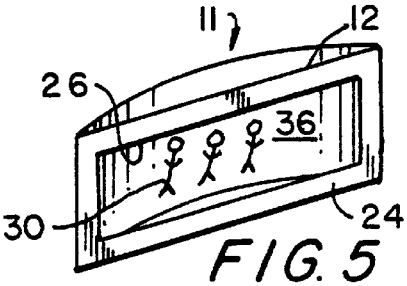
FIG. 5 is a perspective view showing final assembly of the greeting card of the invention into a dioramic format.
Figure 6:
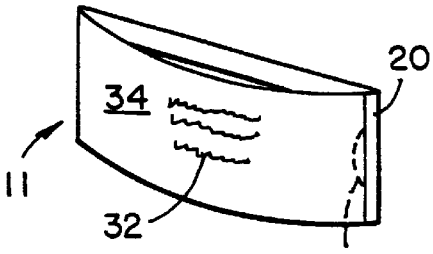
FIG. 6 is a rear perspective view of the greeting card depicted in FIG. 5.

FIGS. 5 and 6 depict a completed "set-up" or erected greeting card of the invention, now generally indicated at 11. In final preparation of setting up greeting card assembly 11, flap panel 20 is bent inwardly and over aligned panels 14 and 16, so that tab 28 may be inserted into and set in slit 22 of panel 14 (see FIG. 6), so as to hold the greeting card assembly in a fixed, "erect," configuration.

Although panels 14 and 16 have essentially the same dimensional configuration, panel 12 does not. Panel 12 has a length slightly less than the length of each of panels 14 and 16, but a height or width that is essentially the same. As a result, when tab 28 of flap panel 20 is inserted into slit 22 of panel 14, aligned panels 14 and 16 are caused to bend outwardly or away from panel 12 (see FIG. 5), thereby defining a concave configuration. Accordingly, picture or photo display 30 or other indicia may now be viewed through window 26 defined by panel 12 in which a three-dimensional dioramic effect is created due to the concave configuration of aligned panels 14 and 16.

Figure 7:
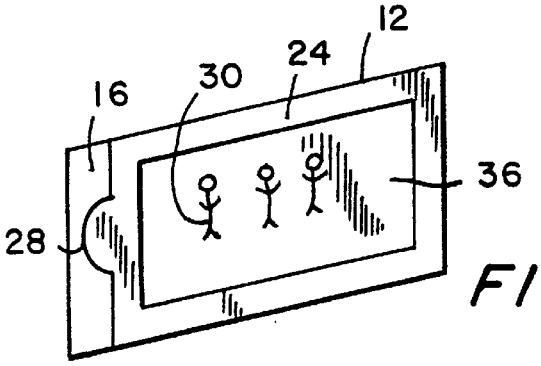
FIG. 7 is a view of the greeting card in flattened, shipping or initial display condition.

In packaging or sending card assembly 11, it is obviously not necessary to have tab 28 inserted into slit 22. The card assembly 11 may be packaged, sold or mailed in a substantially flat condition, facilitating storage or transport. As best seen in FIG. 7, the greeting card blank is initially flat, before being set up, and can be viewed on, say, a rack or display case in this manner at retail shops. In this mode, a viewer will see decorative indicia 30 through frame 24 and be attracted to purchase the same. The purchaser may write greetings on face 40 or any other blank face, and then send the same via mail in a flattened condition to a recipient, who will readily "set up" the card to the format 11 shown in FIG. 6.

One important advantage of one embodiment of the inventive greeting card is that blank 10, which is used in the formation of the card, need only be printed on one side. This produces a substantial cost savings during manufacture.

It will thus be seen that the objects set forth above, among those made apparent from the preceding description, are efficiently attained and, since certain changes may be made in carrying out the above method and the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A flat blank for constructing a dioramic display card comprising:

first, second and third panels, said panels having the same width, said first panel foldably connected to said second panel along a first common fold line, said second panel having a slit, said second panel foldably connected to said third panel along a second common fold line, said first panel foldably connected to a tab along a third common fold line, said first, second and third panels and said tab being connected lengthwise along said first, second and third fold lines;

wherein said second and third panels are substantially rectangular and have substantially the same dimensions;

wherein said first panel has a length dimension somewhat smaller than that of said second and third panels and is formed with a cutout window;

wherein each said panels have a front and a back side with said front sides and said back sides being respectively contiguous when said blank is flat, with said third panel having a decorative indicia on its front side;

said blank being foldable along said fold lines and by insertion of said tab into said slit, to form a dioramic display card with said decorative indicia being viewable through said window.

2. The blank of claim 1, wherein the blank is formed from one of a paper and a paper equivalent material.

3. A dioramic greeting card comprising:

a front panel formed with a viewing window, a back panel foldably connected to said front panel along a common fold line and disposed substantially behind said front panel, and a display panel foldably connected to said back panel along a second common fold line located opposite said first common fold line and disposed between said front and back panels, said display panel having display material on one side thereof viewable through said window;

wherein said back and display panels are substantially the same width and height and said front panel has a width in one lateral direction somewhat smaller than that of said back and display panels;

a tab foldably connected to said front panel for fastening said front panel to said back panel such that each of said back and display panels have a concave configuration with said back and display panels being adjacent, whereby said display material viewed through said window of said front panel has a three dimensional appearance.

4. A greeting card of claim 3, wherein the panels are flat, one above the other, when said tab is disengaged and for shipping purposes.

5. A flat blank for constructing a dioramic card comprising:

first, second and third panels, said first panel foldably connected to said second panel along a first common fold line, said second panel foldably connected to said third panel along a second common fold line;

wherein said second and third panels are substantially rectangular and have substantially the same dimensions;

wherein said first panel has a length dimension somewhat smaller than that of said second and third panels and is formed with a cutout window, and has an edge opposite and parallel to said first common fold line with a tab extending outwardly of said first panel and attached to said second panel at said edge;

wherein each said panels have a front and a back side with said front sides and said back sides being respectively contiguous when said blank is flat, with said third panel having a decorative indicia on its front side;

said blank being foldable along said fold lines to form a dioramic card by attaching said tab adjacent to said second fold line, said card having a frame formed by said first panel and said second and third panel being adjacent to each other to form a back for said dioramic card with said decorative indicia being viewable through said window.

* * * * *